US007711294B2

(12) United States Patent
Mase

(10) Patent No.: US 7,711,294 B2
(45) Date of Patent: May 4, 2010

(54) DEVELOPER CARTRIDGE, DEVELOPING DEVICE AND IMAGE FORMING APPARATUS

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 286 days.

(21) Appl. No.: 12/030,901

(22) Filed: Feb. 14, 2008

(65) Prior Publication Data

US 2008/0260421 A1 Oct. 23, 2008

(30) Foreign Application Priority Data

Mar. 1, 2007 (JP) ..... 2007-051421

(51) Int. Cl.
*G03G 15/08* (2006.01)
*G03G 21/18* (2006.01)

(52) U.S. Cl. ..... 399/262; 399/114

(58) Field of Classification Search ..... 399/114, 399/119, 258, 262
See application file for complete search history.

(56) References Cited

U.S. PATENT DOCUMENTS

| | | | | |
|---|---|---|---|---|
| 4,937,628 | A * | 6/1990 | Cipolla et al. | 399/262 X |
| 5,506,665 | A * | 4/1996 | Ishida et al. | 399/119 |
| 5,809,384 | A * | 9/1998 | Johroku et al. | 399/262 |
| 6,185,401 | B1 | 2/2001 | Kanamori et al. | |
| 6,438,345 | B1 * | 8/2002 | Ban et al. | 399/262 |
| 6,496,671 | B2 * | 12/2002 | Nakajima | 399/262 X |
| 7,266,330 | B2 * | 9/2007 | Murakami et al. | 399/262 |
| 2005/0135842 | A1 * | 6/2005 | Murakami et al. | 399/262 |

FOREIGN PATENT DOCUMENTS

| | | | |
|---|---|---|---|
| JP | 59-009356 | U | 1/1984 |
| JP | 62-019664 | U | 2/1987 |
| JP | 01-219865 | | 1/1989 |
| JP | 02-165174 | | 6/1990 |
| JP | 8-240976 | A | 9/1996 |
| JP | 08-305148 | | 11/1996 |
| JP | 11-352743 | A | 12/1999 |
| JP | 2003-107892 | A | 4/2003 |
| JP | 2006-171199 | A | 6/2006 |
| JP | 2006-267445 | A | 10/2006 |

OTHER PUBLICATIONS

JP Office Action dtd Mar. 5, 2009, JP Appln. 2007-051421, partial English translation.

* cited by examiner

*Primary Examiner*—Sandra L Brase
(74) *Attorney, Agent, or Firm*—Banner & Witcoff, Ltd.

(57) ABSTRACT

A developer cartridge includes a cartridge cabinet that accommodates developer and includes an opening for enabling communication between an inside of the cartridge cabinet and an outside of the cartridge cabinet, a shutter that opens and closes the opening, and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position.

12 Claims, 12 Drawing Sheets

DEVELOPER CARTRIDGE, DEVELOPING DEVICE AND IMAGE FORMING APPARATUS

CROSS-REFERENCE TO RELATED APPLICATIONS

This application claims priority from Japanese Patent Application No. 2007-051421 filed on Mar. 1, 2007, the entire subject matter of which is incorporated herein by reference.

TECHNICAL FIELD

Aspects of the present invention relate to an image forming apparatus, and a developer cartridge and a developing device detachably attached to the image forming apparatus.

BACKGROUND

There has been proposed an image forming apparatus such as a laser printer, in which a toner cartridge is detachably attached to a developing device.

For example, JP-A-1-219865 discloses a toner replenishment apparatus, in which a toner cartridge is detachably attached to a developing unit in the image forming apparatus. A toner replenishment port is opened in the bottom of the toner replenishment apparatus. A toner accommodated in the toner replenishment apparatus drops from the toner replenishment port and is supplied to the developing unit.

In the toner replenishment apparatus, a first shutter unit is disposed in an upper part of the toner replenishment port. A second shutter unit is disposed in a lower part of the toner replenishment port i.e., the outside of the toner replenishment apparatus.

The first shutter unit includes a rotatable rotary shutter. The rotary shutter closes the toner replenishment port from the upper side when a top cover of an image forming apparatus body is in an opened state in a state where the toner replenishment apparatus is attached to the image forming apparatus. As the top cover changes to a closed state, the rotary shutter rotates so as to open the toner replenishment port from the upper side.

The second shutter unit includes a slidable slide shutter. The slide shutter opens the toner replenishment port from the lower side by sliding as the toner replenishment apparatus is attached to the image forming apparatus while the slide shutter closes the toner replenishment port from the lower side in a state of detaching the toner replenishment apparatus from the image forming apparatus.

The toner replenishment apparatus of JP-A-1-219865 doubly disposes the shutters with respect to the toner replenishment port in order to prevent the toner from leaking from the toner replenishment port. However, the toner may leak from the toner replenishment port due to an influence of vibration by opening and closing at the time of opening and closing the slide shutter outward arranged in the toner replenishment apparatus.

SUMMARY

Aspects of the invention provide a developer cartridge capable of preventing leakage of developer, a developing device to which the developer cartridge is detachably attached, and an image forming apparatus to which the developer cartridge and developing device are detachably attached.

DETAILED DESCRIPTION

<General Overview>

Figure 1:
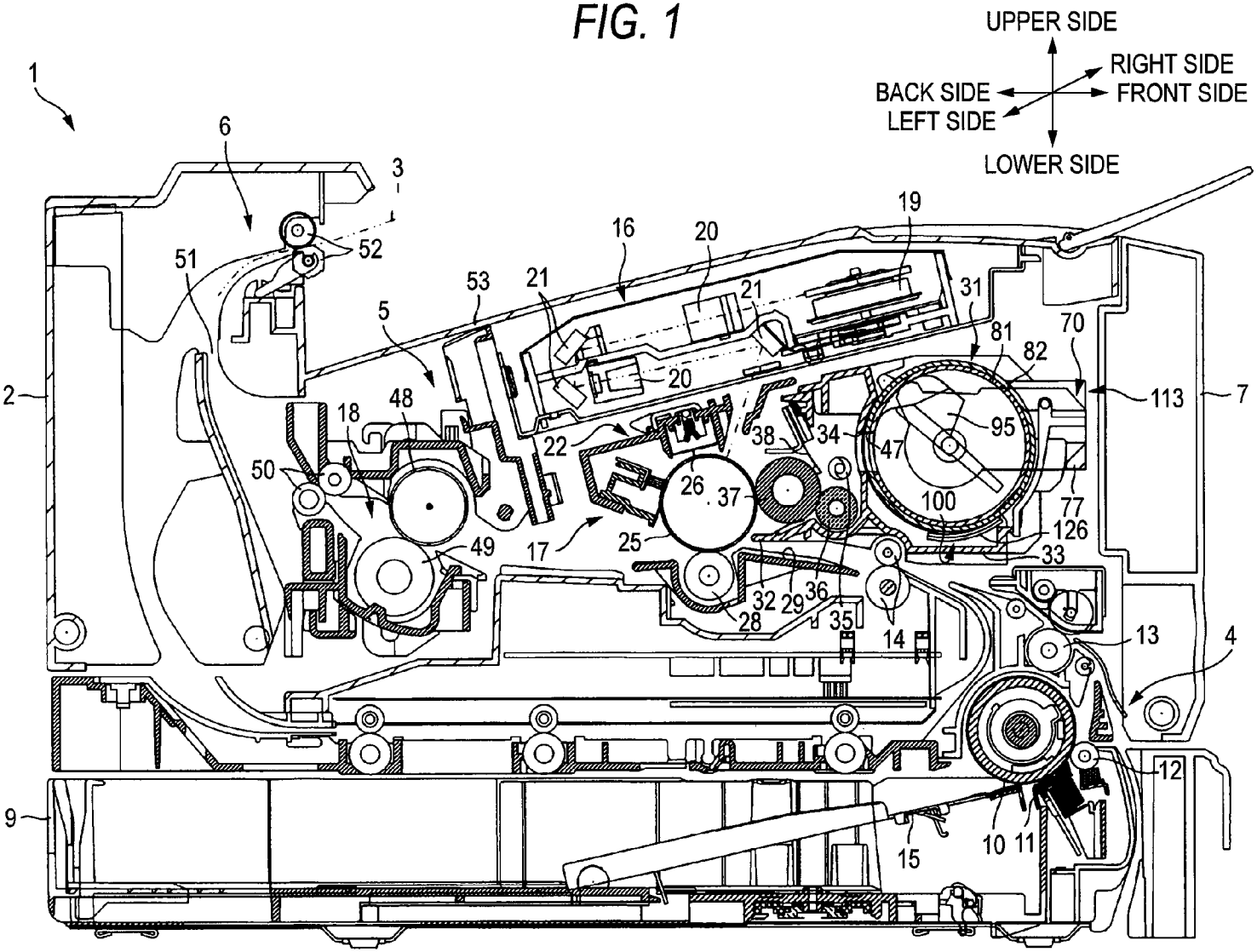
FIG. 1 is an exemplary side sectional view showing an image forming apparatus according to an aspect of the present invention.

According to an aspect of the present invention, there is provided a developer cartridge including: a cartridge cabinet that accommodates developer and includes an opening for enabling communication between an inside of the cartridge cabinet and an outside of the cartridge cabinet; a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position.

According to another aspect of the present invention, there is provided a developing device including: a developer cartridge including: a cartridge cabinet that accommodates developer and includes an opening for enabling communication between an inside of the cartridge cabinet and an outside of the cartridge cabinet; a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position; a developing cabinet, the developer cartridge being attachable to and detachable from the developing cabinet; and a developer carrier that is supported in the developing cabinet and carries the developer to a photosensitive member, wherein the developer cartridge further includes a protrusion part for moving the cover from the closed position to the opened position according to attachment of the developer cartridge to the developing cabinet.

According to still another aspect of the present invention, there is provided an image forming apparatus including a developing device, the developing device including: a developer cartridge including: a cartridge cabinet that accommodates developer and includes an opening for enabling communication between an inside of the cartridge cabinet and an outside of the cartridge cabinet; a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position; a developing cabinet, the developer cartridge being attachable to and detachable from the developing cabinet, the developing cabinet including an operation member, wherein the protrusion part moves the cover from the closed position to the opened position by being pressed on the operation member according to attachment of the developer cartridge to the developing cabinet; and a developer carrier that is supported in the developing cabinet and carries the developer to a photosensitive member, wherein the developer cartridge further includes a protrusion part for moving the cover from the closed position to the opened position according to attachment of the developer cartridge to the developing cabinet.

<Illustrative Aspects>

(Image Forming Apparatus)

Figure 2:
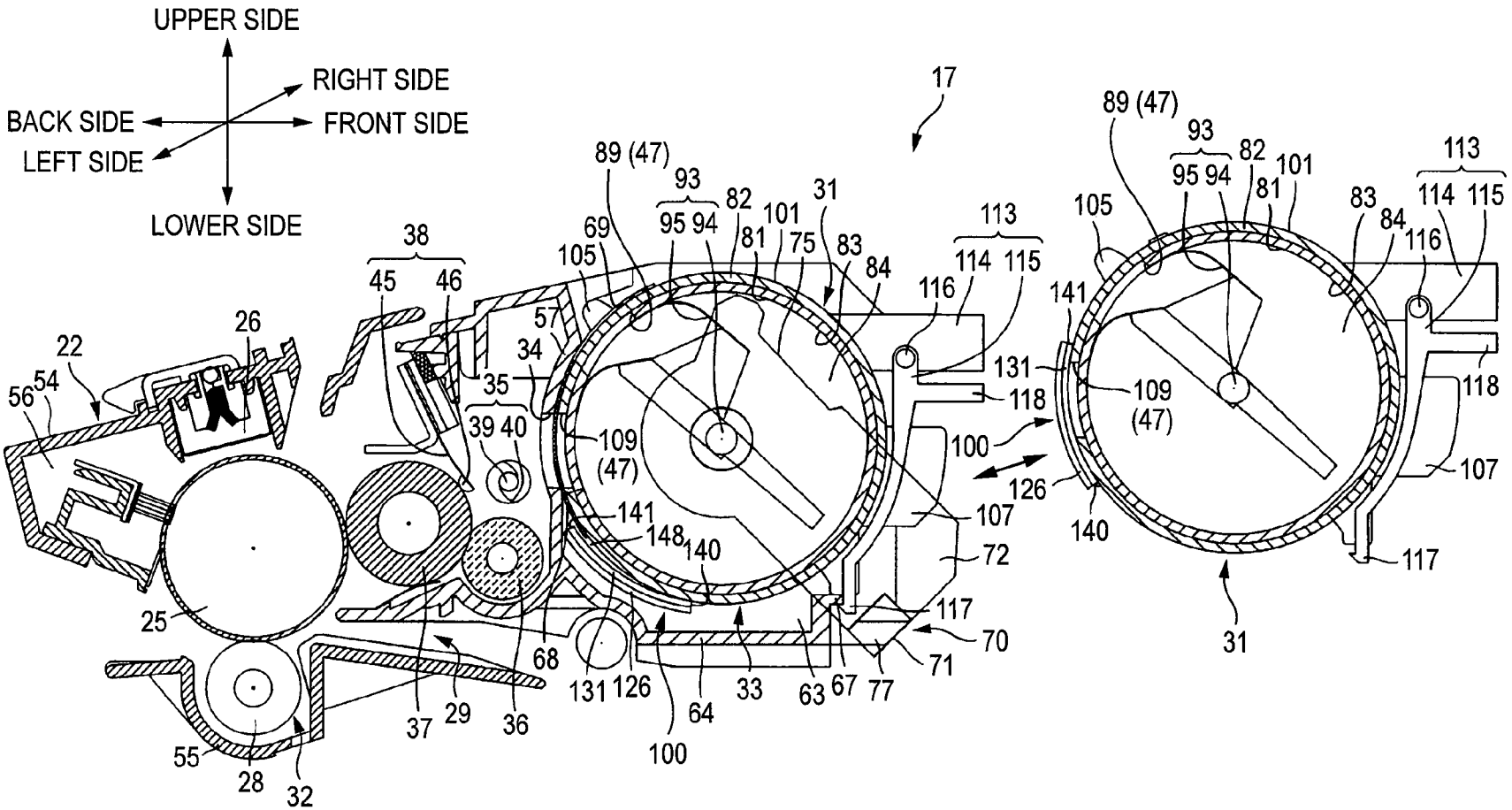
FIG. 2 is an exemplary side sectional view of a developer cartridge and a developing device according to an aspect of the present invention wherein the developing device is in a state in which the developer cartridge is attached to the developing device and a swing arm is in a pressing release position.
Figure 3:
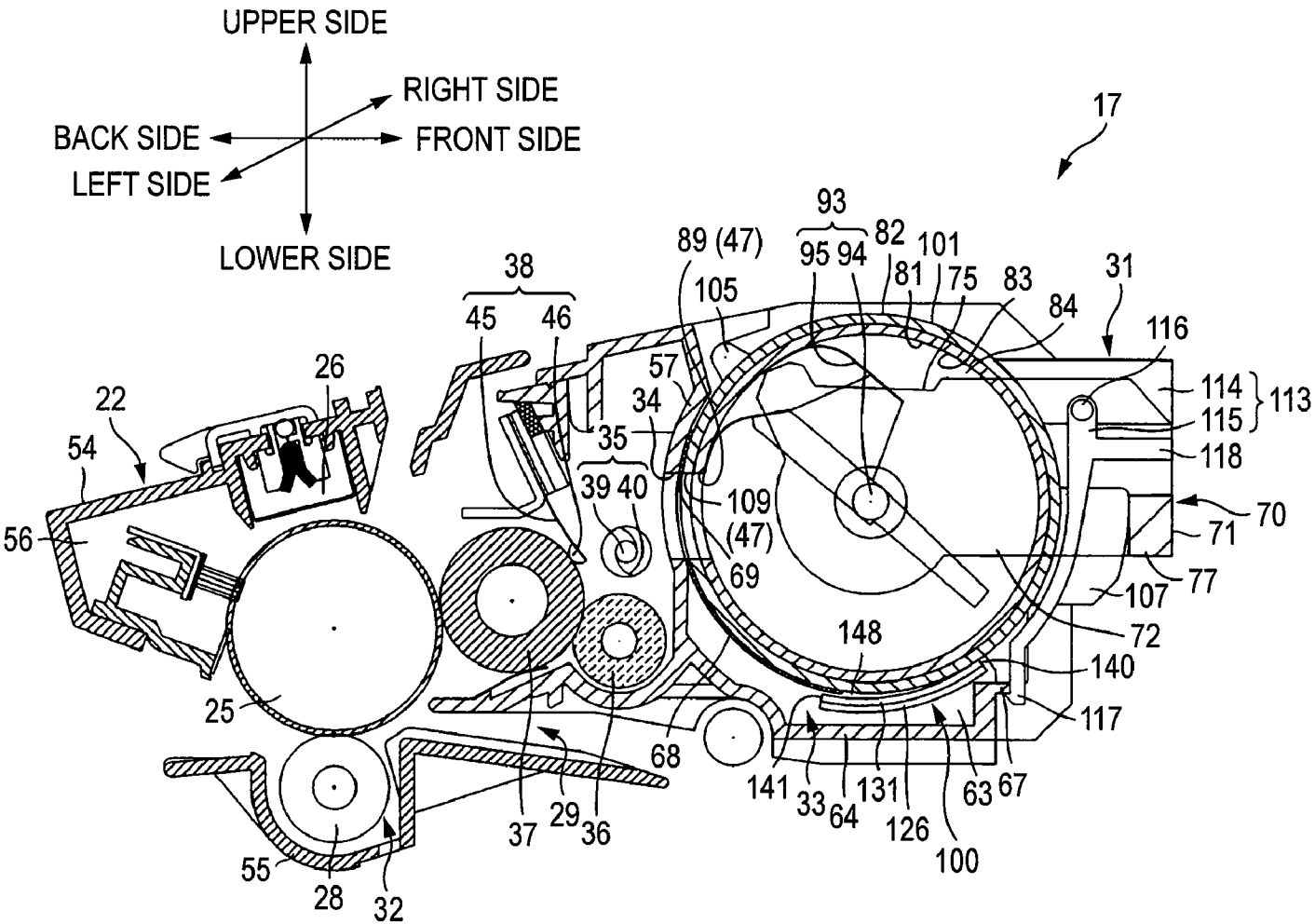
FIG. 3 is an exemplary side sectional view of the developing device in a state in which the developer cartridge is attached to the developing device and the swing arm is in a pressing position.

FIG. 1 is an exemplary side sectional view showing an image forming apparatus according to an aspect of the present invention. FIG. 2 is an exemplary side sectional view of a developer cartridge and a developing device wherein the developing device is in a state in which the developer cartridge is attached to the developing device and a swing arm is in a pressing release position. FIG. 3 is an exemplary side sectional view of the developing device in a state in which the developer cartridge is attached to the developing device and the swing arm is in a pressing position.

The laser printer 1 includes a feeder unit 4 for feeding a sheet 3 to the inside of a body casing 2, an image forming unit 5 for forming an image on the fed sheet 3, and a sheet discharge part 6 for delivering the sheet 3 on which the image is formed as shown in FIG. 1.

(1) Body Casing

The body casing 2 is formed in a box shape, and an opening is formed in a sidewall of one side of the body casing 2, and a front cover 7 for opening and closing an opening is disposed. By opening a front cover 7, a developing device 17 (described below) can be attached to and detached from the body casing 2.

In addition, in the following description, the side in which the front cover 7 is disposed is referred to as a front side (front face side) and the opposite side is referred to as a back side (rear side). The front side of a sheet thickness direction in FIG. 1 is referred to as a left side, and the back side of the sheet thickness direction in FIG. 1 is referred to as a right side. Incidentally, left and right directions are synonymous with a width direction. Further, in the following description related to a developing device 17 and a developer cartridge 31, a state in which a frame side passage port 34 and a cartridge side passage port 47 described below face in a horizontal direction is used as the reference.

(2) Feeder Unit

The feeder unit 4 includes a sheet feeding tray 9, a sheet feeding roller 10, a sheet feeding pad 11, sheet powder removal rollers 12 and 13, register rollers 14, and a sheet press plate 15. Then, the uppermost sheet 3 of the sheet press plate 15 is fed out one at a time by the sheet feeding roller 10 and the sheet feeding pad 11 and passes through various rollers 12 to 14 and thereafter, is conveyed to a transfer position (described below) of the image forming unit 5.

(3) Image Forming Unit

The image forming unit 5 includes a scanner unit 16, the developing device 17, and a fixing part 18. In FIG. 1, the developing device 17 is embodied in the form of a process cartridge by way of an example. However, one of ordinary skill in the art will appreciate that the present inventive concept will apply equally to any unit which may be used for developing.

(3-1) Scanner Unit

The scanner unit 16 is arranged in an upper part of the inside of the body casing 2, and includes a laser light emitting part (not shown), a polygon mirror 19 rotated and driven, plural lenses 20 and plural reflecting mirrors 21. A laser beam based on image data emitted from the laser light emitting part is reflected by the polygon mirror 19 and passes through or is reflected by the plural lenses 20 and the plural reflecting mirrors 21 and is scanned to a surface of a photoconductive drum 25 (described below) of the developing device 17 as shown by a chain line.

(3-2) Developing Device

The developing device 17 is arranged under the scanner unit 16 in the inside of the body casing 2 and is detachably attached to the body casing 2.

As shown in FIGS. 2 and 3, the developing device 17 includes a process frame 22 as one example of a developing cabinet in which a transfer path 29 for permitting passage of the sheet 3 is formed, and the developer cartridge 31 detachably attached to a cartridge receiving part 33 of the process frame 22.

In the process frame 22, a partition wall 57 extending in upper and lower directions is disposed in substantially the center position in front and back directions of the process frame 22, and the backside portion of the partition wall 57 forms a developing part 32 and the front side portion of the partition wall 57 forms the cartridge receiving part 33 described above. The frame side passage port 34 is formed in the partition wall 57.

The photoconductive drum 25 as one example of a photosensitive member, a scorotron-type charger 26, a transfer roller 28, an auger 35, a supply roller 36, a developing roller 37 as one example of a developer carrier, and a layer thickness regulating blade 38 are mounted inside the developing part 32.

The photoconductive drum 25 is rotatably supported in the process frame 22. The scorotron-type charger 26 is supported in the process frame 22 over the photoconductive drum 25 in a state spaced from the photoconductive drum 25. The transfer roller 28 is arranged as opposed to the photoconductive drum 25 from the lower side of the photoconductive drum 25 and is rotatably supported in the process frame 22. The developing roller 37 is longitudinal in the width direction and is arranged as opposed to the front side of the photoconductive drum 25. The supply roller 36 is arranged as opposed to the front side of the developing roller 37. The developing roller 37 and the supply roller 36 are rotatably supported in the process frame 22. The layer thickness regulating blade 38 includes a leaf spring member 45 formed in a thin plate shape, and a pressure contact rubber 46 disposed in the lower end of the leaf spring member 45. The upper end of the leaf spring member 45 is fixed to the process frame 22, and the pressure contact rubber 46 presses a surface of the developing roller 37 by elastic force of the leaf spring member 45. The auger 35 is arranged as opposed to the frame side passage port 34 in the back side of the frame side passage port 34. The auger 35 includes an auger shaft 39, and a screw 40 disposed around the auger shaft 39. The auger shaft 39 is arranged so that a center portion of the shaft 39 extends along the width direction, and is rotatably supported in the process frame 22 over the supply roller 36.

The developer cartridge 31 is detachably attached to the process frame 22 in the cartridge receiving part 33. In addition, a direction of attaching and detaching the developer cartridge 31 to and from the process frame 22 is substantially a horizontal direction (see an arrow of a thick line of FIG. 2). The developer cartridge 31 is formed in substantially a cylindrical shape. A cartridge side passage port 47 (described below) for communicating the inside to the outside is formed in the developer cartridge 31.

An agitator 93 (described below) is disposed inside the developer cartridge 31 for accommodating developer inside the developer cartridge 31. In the image forming apparatus 1 of the aspect, the developer includes a nonmagnetic one-component toner with positive electrification.

Referring to FIG. 3, the developer accommodated inside of the developer cartridge 31 is agitated by rotation of the agitator 93 and is received from the cartridge side passage port 47 to the frame side passage port 34 and is discharged to the inside of the developing part 32. The discharged developer is supplied to the supply roller 36 while being transported from the center of the width direction to both sides of the width direction by rotation of the auger 35. Also, a part of the developer is returned to the inside of the developer cartridge 31 through the frame side passage port 34 and the cartridge side passage port 47. Consequently, circulation of the developer between the developer cartridge 31 and the developing part 32 of the process frame 22 is ensured.

The developer supplied to the supply roller 36 is supplied to the developing roller 37 by rotation of the supply roller 36. At this time, the developer is frictionally electrified in positive polarity between the supply roller 36 and the developing roller 37. Subsequently, the developer supplied to the developing roller 37 is carried as a thin layer on a surface of the developing roller 37 while with rotation of the developing roller 37, the developer enters between the pressure contact rubber 46 and the developing roller 37 and a layer thickness of the developer is regulated between the pressure contact rubber 46 and the developing roller 37.

Then, after a surface of the photoconductive drum 25 is first positively electrified uniformly by the scorotron-type charger 26 with rotation of the photoconductive drum 25, the surface is exposed by a laser beam from the scanner unit 16 and an electrostatic latent image based on image data is formed. When the developer carried on a surface of the developing roller 37 oppositely makes contact with the photoconductive drum 25 by rotation of the developing roller 37, the developer is carried to the electrostatic latent image formed on the surface of the photoconductive drum 25. Consequently, the electrostatic latent image is developed (imaged) and a developer image is carried on the surface of the photoconductive drum 25. The developer image is transferred to the sheet 3 conveyed between the photoconductive drum 25 and the transfer roller 28 (a transfer position) in the transfer path 29.

(3-3) Fixing Part

The fixing part 18 is disposed at the back of the developing device 17 as shown in FIG. 1. The fixing part 18 includes a heating roller 48, a pressurizing roller 49 brought into pressure contact with the heating roller 48 from the lower side, and a pair of conveying rollers 50 arranged in the back side of their rollers.

In the fixing part 18, the developer transferred to the sheet 3 in the transfer position is thermally fixed while the sheet 3 passes between the heating roller 48 and the pressurizing roller 49 and thereafter, the sheet 3 is conveyed to the sheet discharge part 6 by the pair of conveying rollers 50.

(4) Sheet Discharge Part

The sheet discharge part 6 includes a sheet discharge path 51, sheet delivery rollers 52, and a sheet delivery tray 53. The sheet 3 conveyed from the fixing part 18 to the sheet discharge path 51 is conveyed from the sheet discharge path 51 to the sheet delivery rollers 52 and is delivered on the sheet delivery tray 53 by the sheet delivery rollers 52.

(Developing Device)

Figure 4:
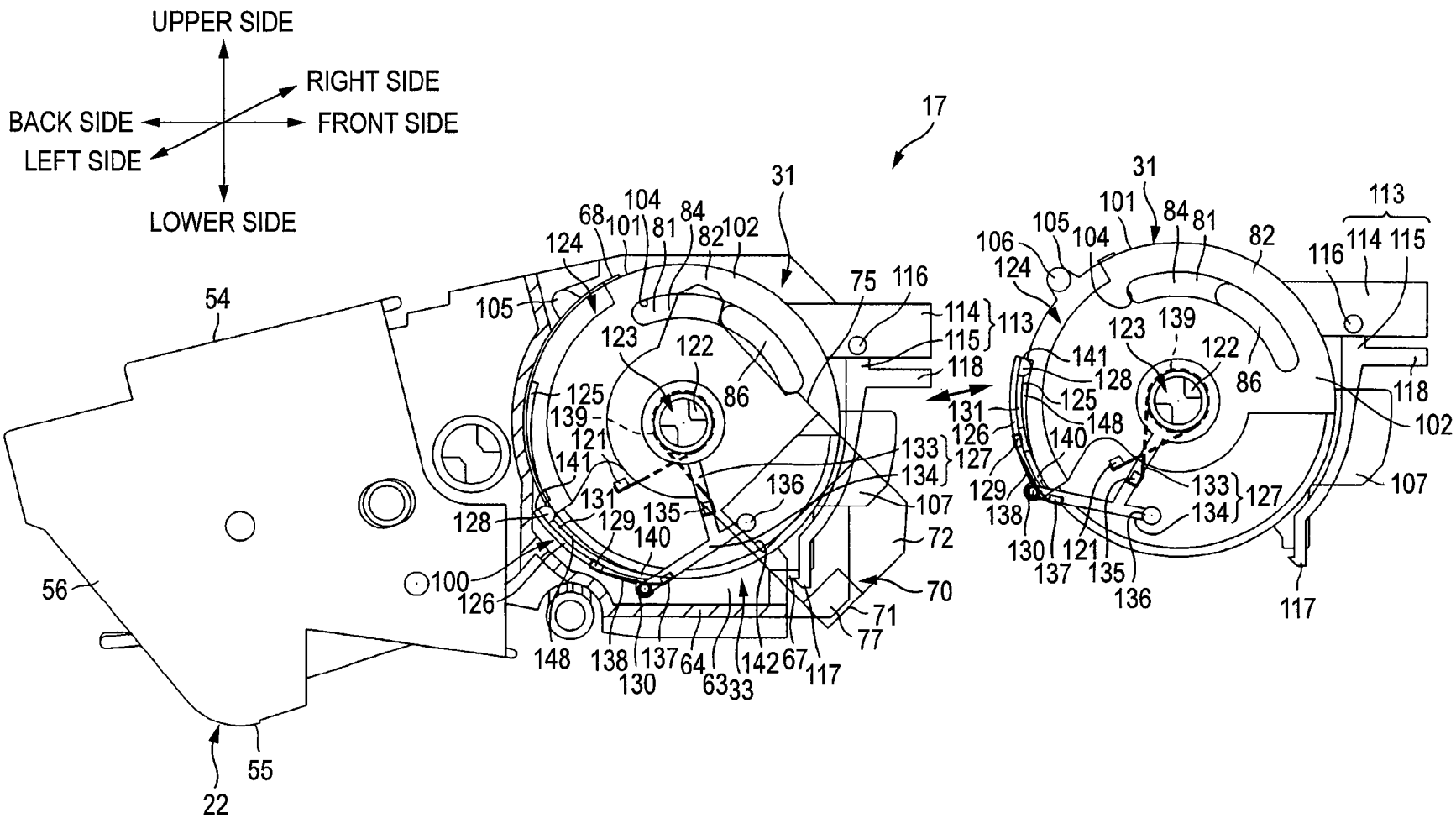
FIG. 4 is an exemplary side view of the developer cartridge and the developing device wherein the developing device is in a state in which the developer cartridge is attached to the developing device and the swing arm is in the pressing release position.
Figure 5:
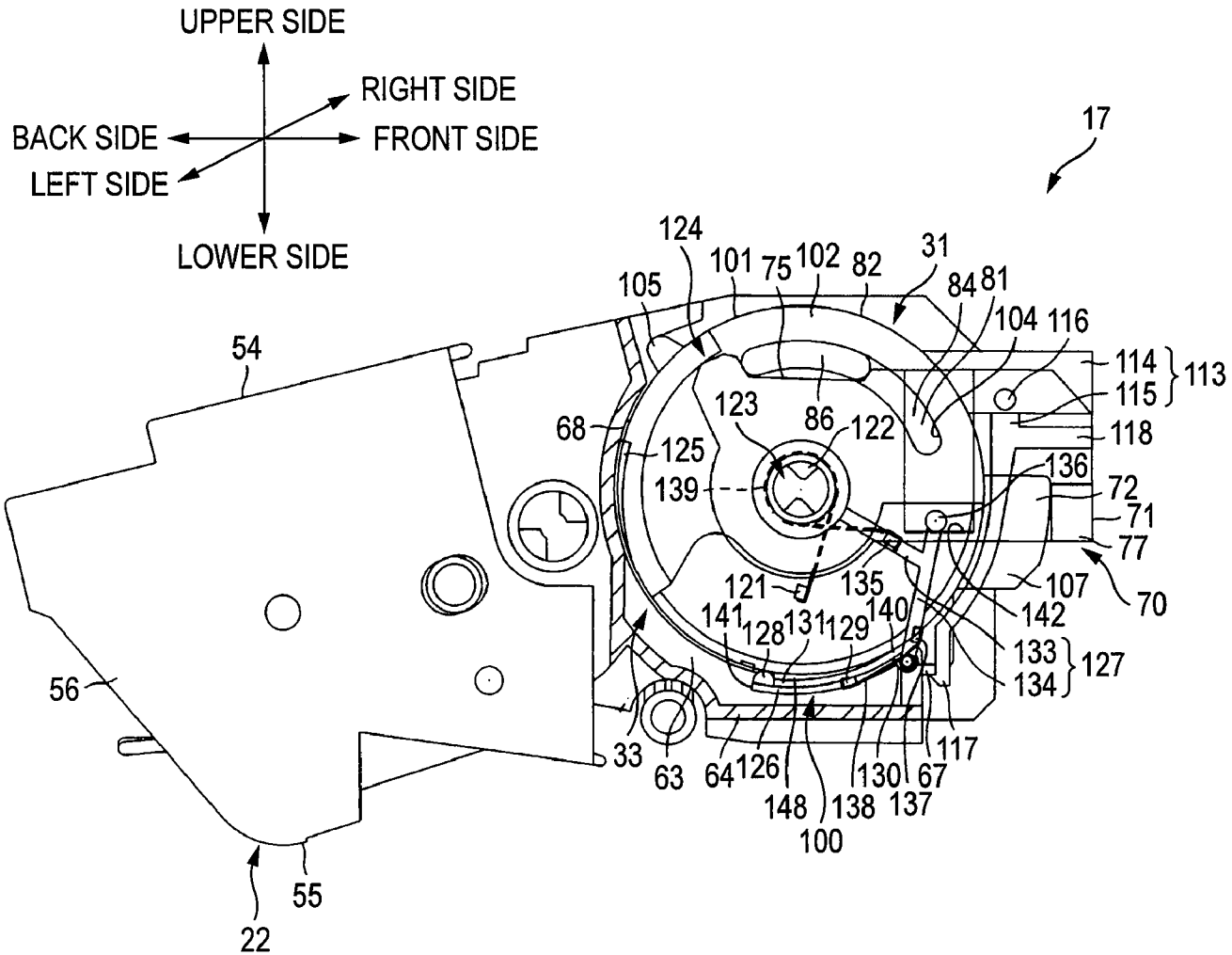
FIG. 5 is an exemplary side view of the developing device in a state in which the developer cartridge is attached to the developing device and the swing arm is in the pressing position.
Figure 6:
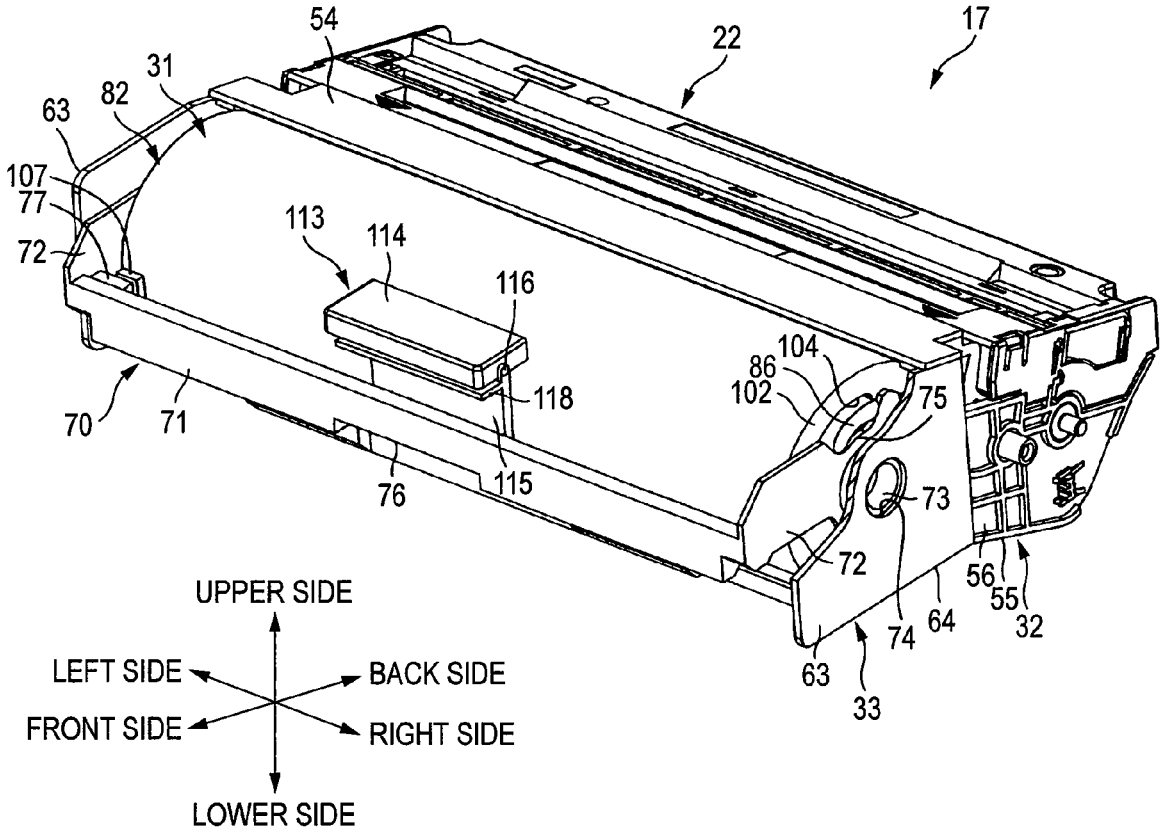
FIG. 6 is a schematic perspective view of the developing device as viewed from a diagonal front right side.
Figure 7:
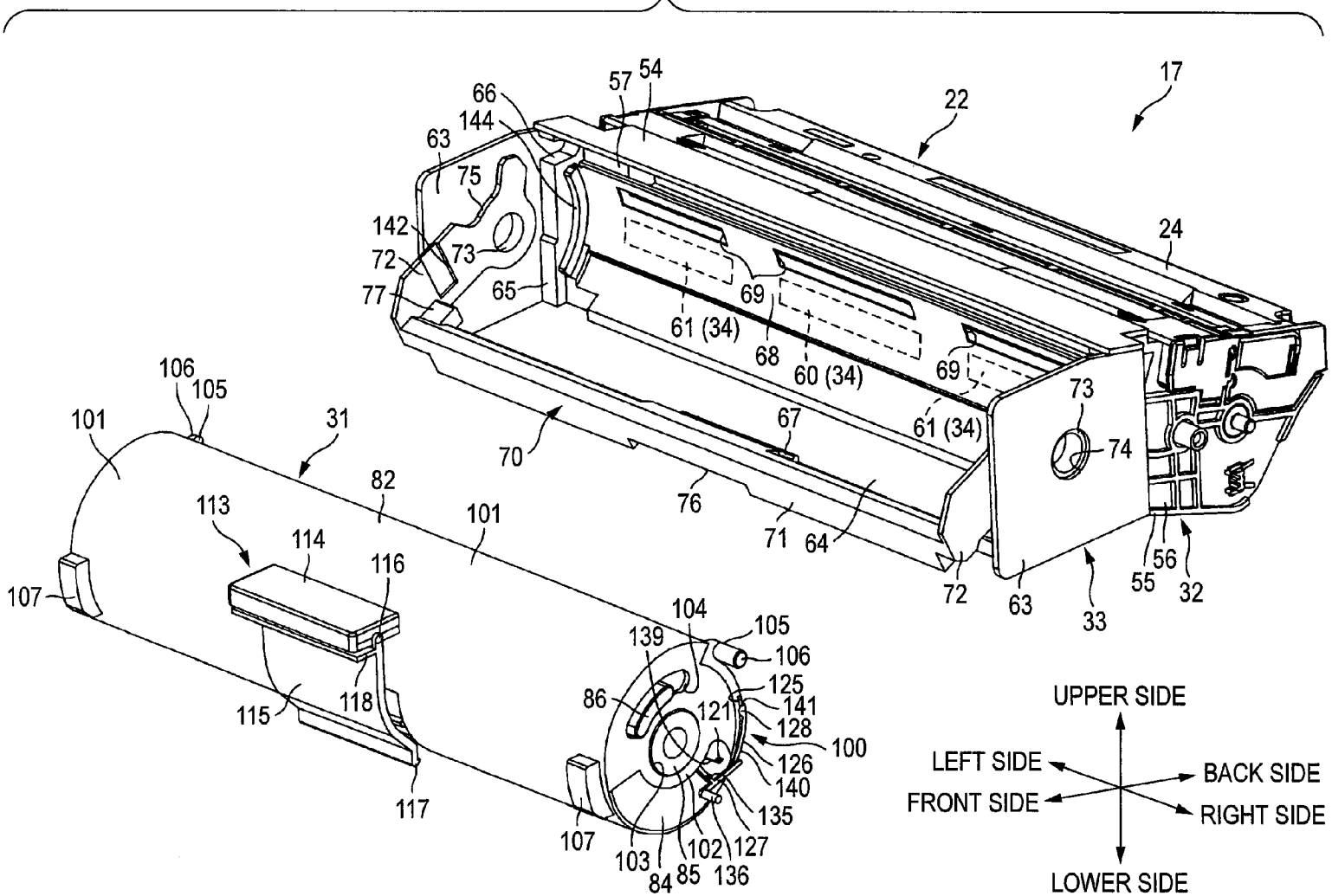
FIG. 7 is a schematic perspective view of the developing device, as viewed from a diagonal front right side, in a state in which the developer cartridge is detached from the developing device.
Figure 8:
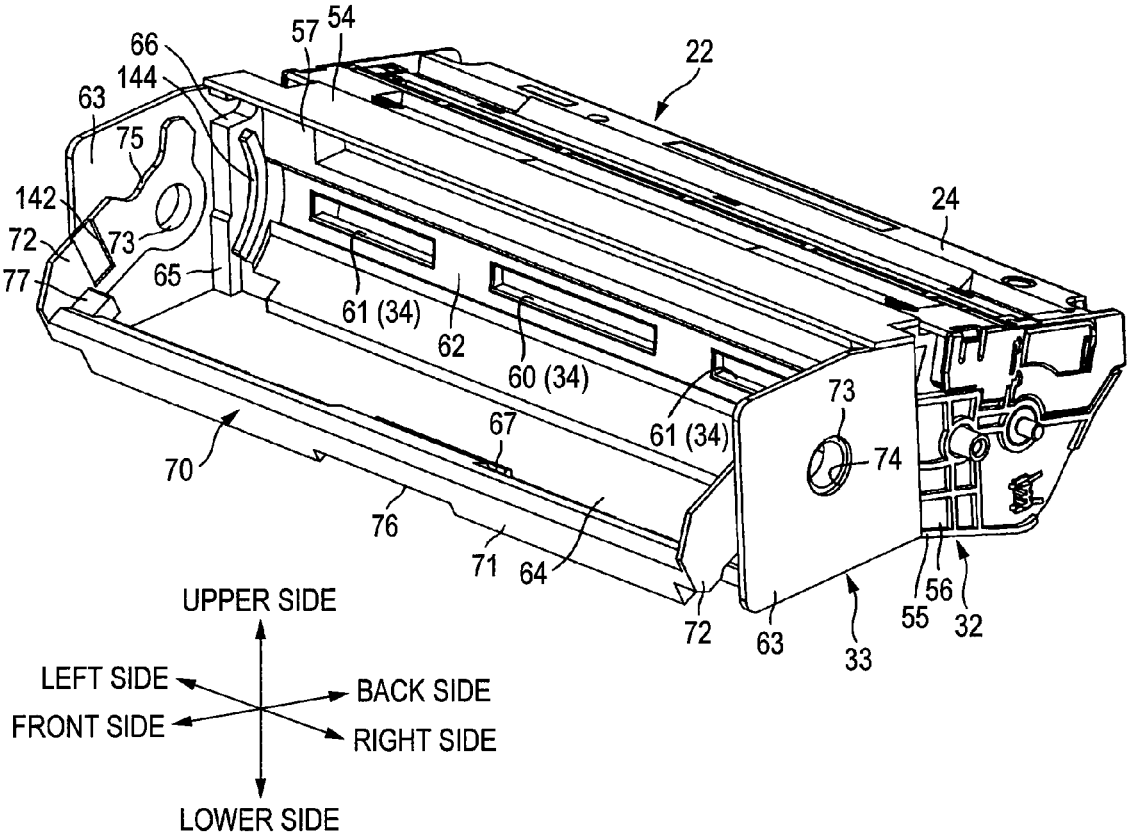
FIG. 8 is a schematic perspective view of the developing device in which a shutter is omitted in FIG. 7.
Figure 9:
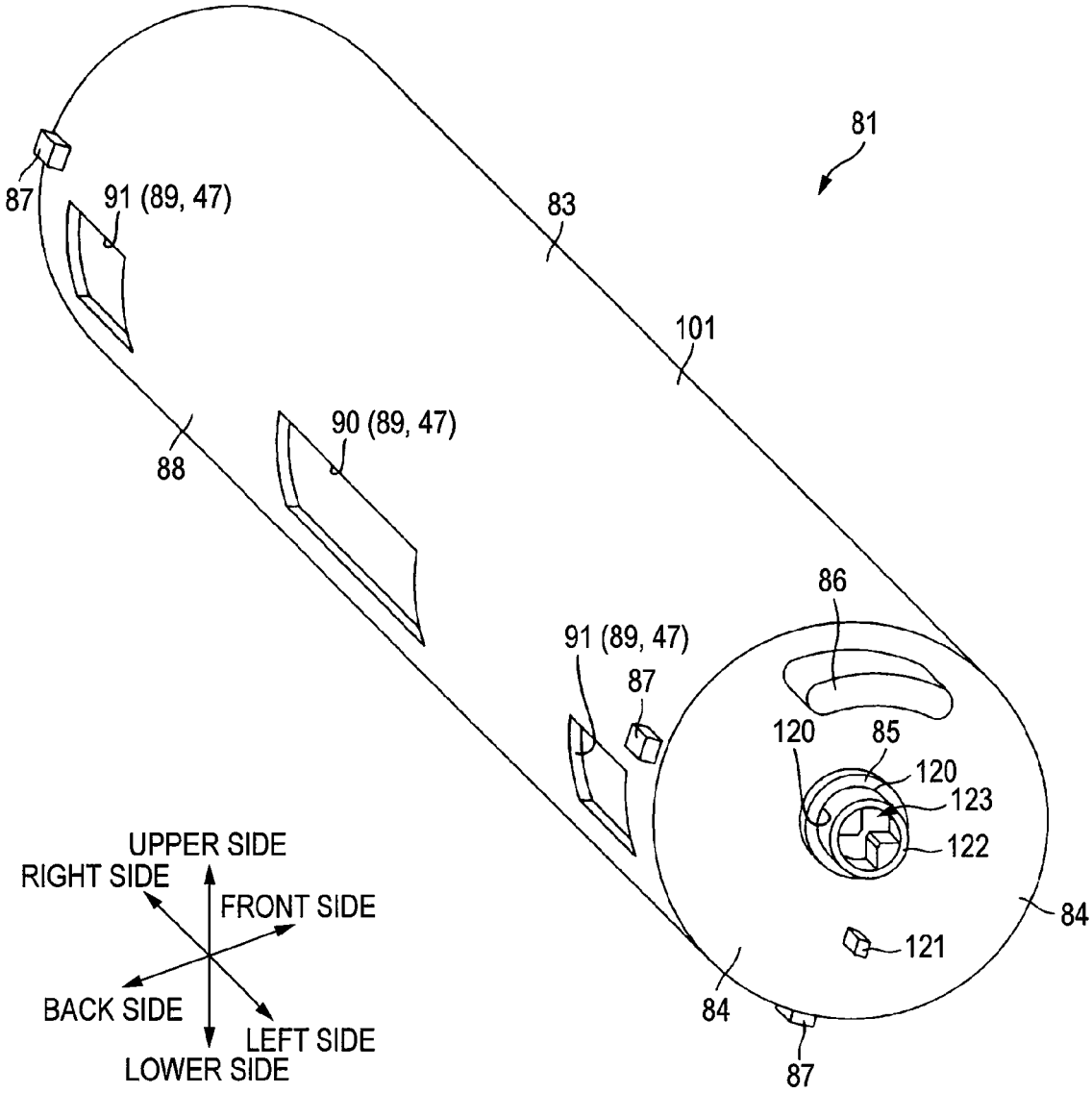
FIG. 9 is an exemplary perspective view of an inside cabinet of the developer cartridge as viewed from a diagonal back left side.
Figure 10:
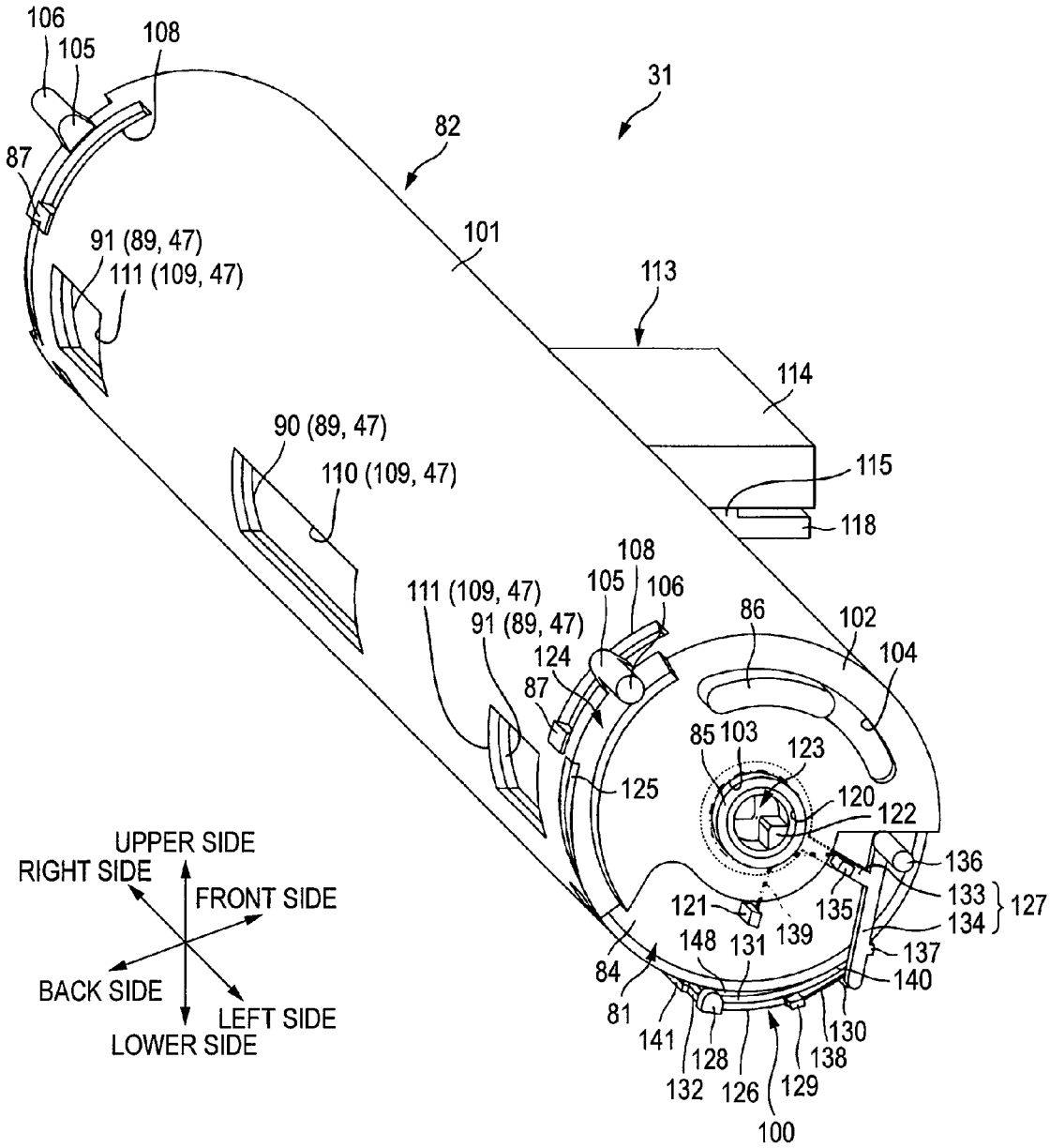
FIG. 10 is an exemplary perspective view of the developer cartridge, as viewed from the diagonal back left side, in a state in which the inside cabinet is in an opened position and a cover is in a retracted position.
Figure 11:
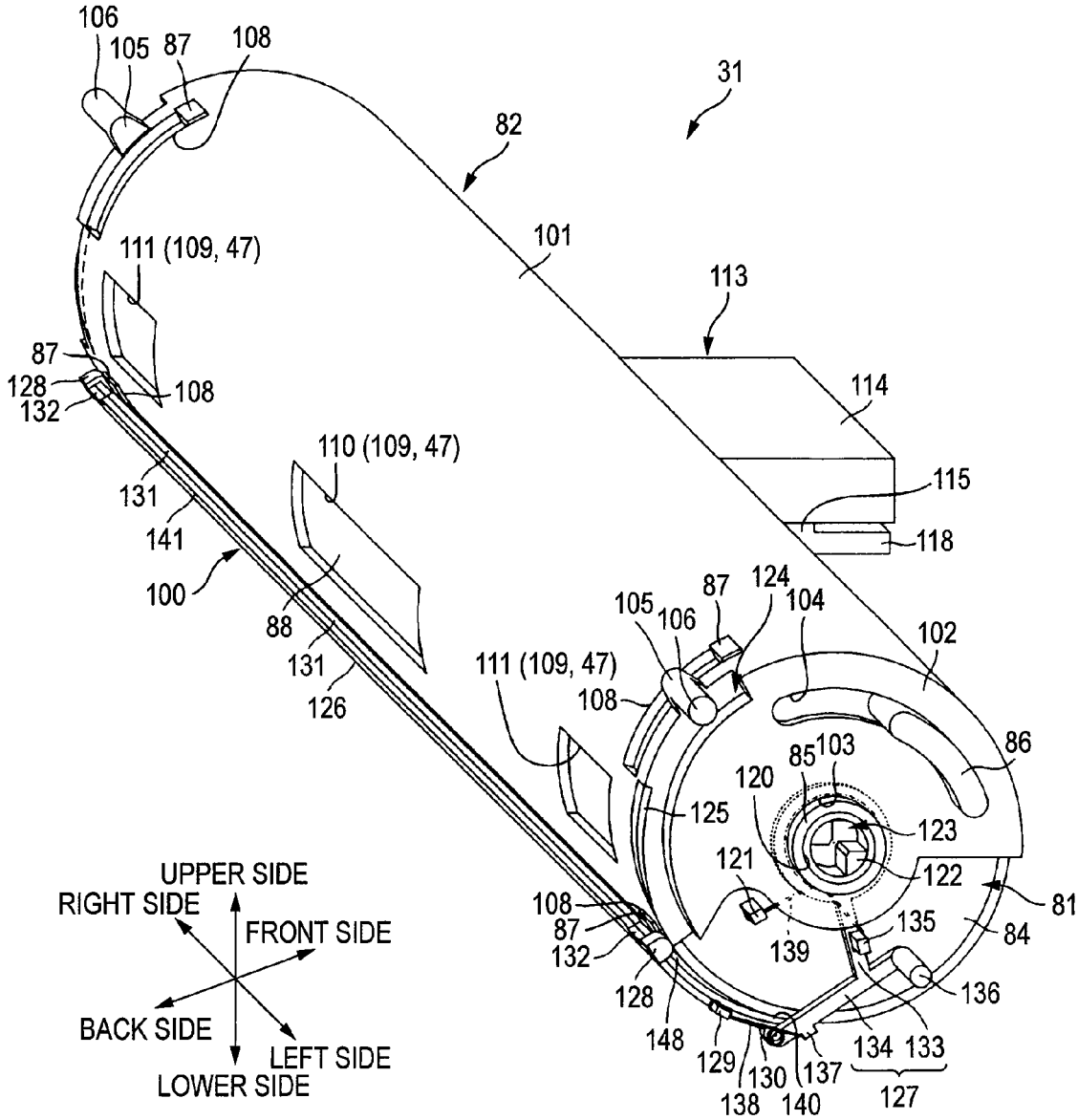
FIG. 11 is an exemplary perspective view of the developer cartridge, as viewed from the diagonal back left side, in a state in which the inside cabinet is in a closed position and the cover is in an opened position.
Figure 12:
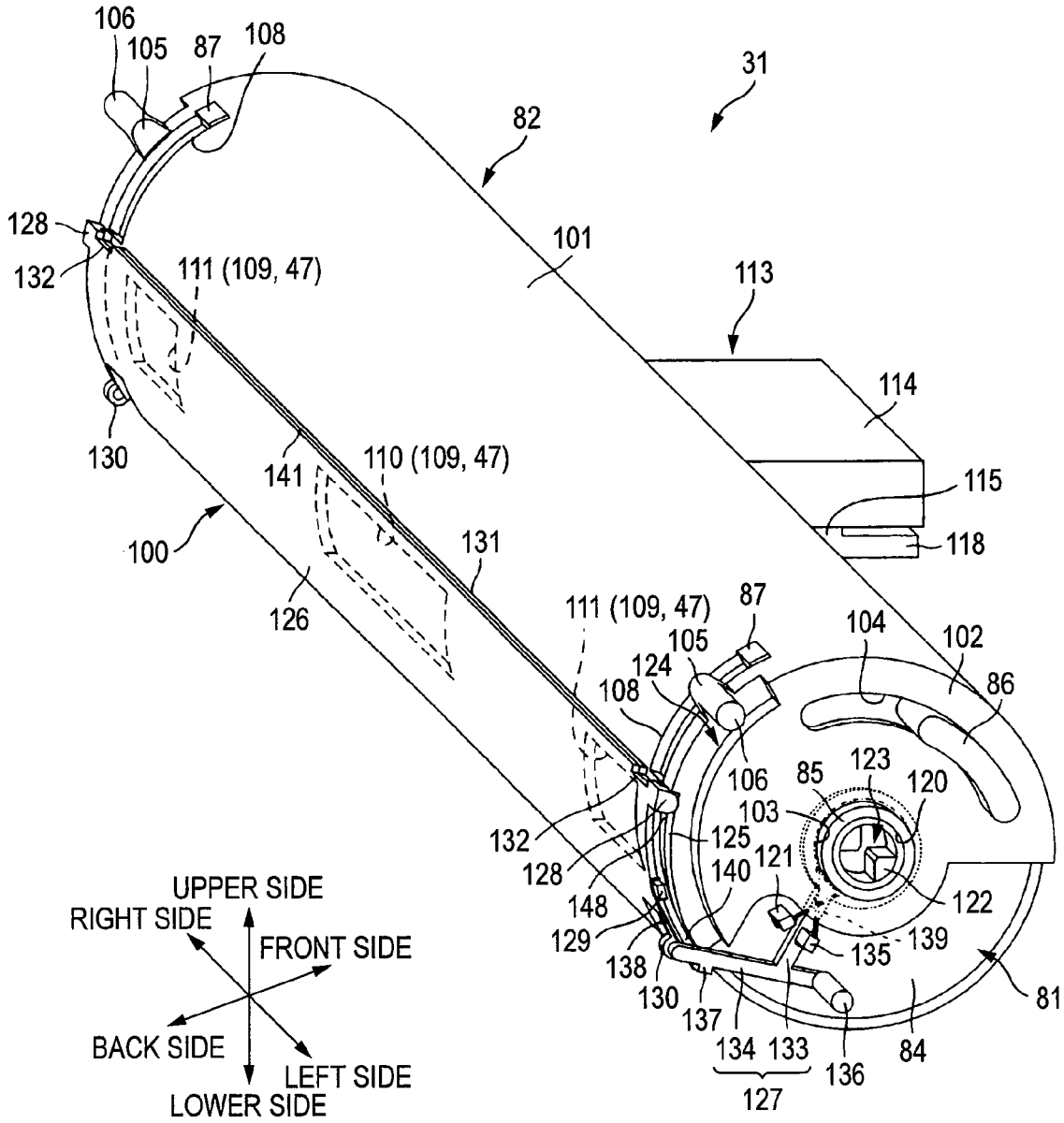
FIG. 12 is an exemplary perspective view of the developer cartridge, as viewed from the diagonal back left side, in a state in which the inside cabinet is in the closed position and the cover is in a closed position.

FIG. 4 is an exemplary side view of a developer cartridge and the developing device wherein the developing device is in a state in which the developer cartridge is attached to the developing device and the swing arm is in a pressing release position. FIG. 5 is an exemplary side view of the developing device in a state in which the developer cartridge is attached to the developing device and the swing arm is in a pressing position. FIG. 6 is a schematic perspective view of the developing device as viewed from a diagonal front right side. FIG. 7 is a schematic perspective view of the developing device, as viewed from the diagonal front right side, in a state in which the developer cartridge is detached from the developing device. FIG. 8 is a schematic perspective view of the developing device in which a shutter is omitted in FIG. 7. FIG. 9 is an exemplary perspective view of an inside cabinet of the developer cartridge as viewed from a diagonal back left side. FIG. 10 is an exemplary perspective view of the developer cartridge, as viewed from the diagonal back left side, in a state in which the inside cabinet is in an opened position and a cover is in a retracted position. FIG. 11 is an exemplary perspective view of the developer cartridge, as viewed from the diagonal back left side, in a state in which the inside cabinet is in a closed position and the cover is in an opened position. FIG. 12 is an exemplary perspective view of the developer cartridge, as viewed from the diagonal back left side, in a state in which the inside cabinet is in the closed position and the cover is in a closed position.

(1) Process Frame

The process frame 22 integrally includes the developing part 32 and the cartridge receiving part 33 as shown in FIG. 7.

(1-1) Developing Part

The developing part 32 integrally includes an upper wall 54, a bottom wall 55, both side walls 56 and the partition wall 57 as shown in FIGS. 2, 3 and 7. Both the side walls 56 are arranged as opposed to each other at a spacing in the width direction. Each of the side walls 56 is arranged along the front and back directions.

The developing roller 37 is supported in the process frame 22 by being rotatably supported in the front side of both the side walls 56.

The supply roller 36 is supported in the process frame 22 by being rotatably supported in the front side of both the side walls 56 in the front side of the developing roller 37.

The auger 35 is supported in the process frame 22 by rotatably supporting the auger shaft 39 in the front side of both the side walls 56 in the upper side of the supply roller 36.

In the partition wall 57, a curved portion along an outer peripheral surface of the developer cartridge 31 is formed in the middle of the upper and lower directions as shown in FIGS. 2 and 3.

The frame side passage ports 34 described above are formed in the curved portion of the partition wall 57 as shown in FIG. 8.

Concretely, three frame side passage ports 34 are formed at a spacing in the width direction. Each of the frame side passage ports 34 is formed in substantially a rectangular shape elongated in the width direction. The frame side passage port 34 formed in the center of the width direction of the partition wall 57 among the frame side passage ports 34 is used as a frame side supply port 60 and the frame side passage ports 34 of both sides of the width direction of the frame side supply port 60 are used as frame side return ports 61.

The outside ends of the width direction of the frame side return ports 61 are arranged in the inside of the width direction (center side of the width direction) from the outside ends of the width direction of a roller portion of the supply roller 36.

A frame side seal 62 for preventing leakage of the developer from the frame side passage ports 34 in the peripheral edges of the frame side passage ports 34 is disposed in the curved portion of the partition wall 57.

The frame side seal 62 is formed from an elastic material such as felt in a band shape extending in the width direction, and a notched portion is formed in correspondence with each of the frame side passage ports 34. The frame side seal 62 is pasted along the width direction so that each of the notched portions is opposed to each of the frame side passage ports 34 in the middle of the upper and lower directions of the partition wall 57.

Consequently, the frame side seal 62 is disposed on a surface (front) of the curved portion of the partition wall 57 so as to coat the peripheral edge of each of the frame side passage ports 34 and continue between each of the frame side passage ports 34. In addition, the frame side seal 62 is not represented in the drawings other than FIG. 8 for convenience of description.

(1-2) Cartridge Receiving Part

The cartridge receiving part 33 includes both side plates 63 and a bottom plate 64 as shown in FIG. 7. Both the side plates 63 and the bottom plate 64 of the cartridge receiving part 33 are integrally formed continuously with both the side walls 56 and the bottom wall 55 of the developing part 32. Shutter support parts 65 are disposed on inside surfaces of the width direction of both the side plates 63. The shutter support part 65 is formed in substantially a rectangular shape inward bulging from an inside surface of the width direction of both the side plates 63 and is disposed so as to extend in the upper and lower directions in the back ends of both the side plates 63.

A shutter guide part 144 is disposed on an inside surface of the width direction of each of the shutter support parts 65. Each of the shutter guide parts 144 forms a protrusion stripe inward bulging from the inside surface of the width direction of the shutter support part 65, and is arranged as opposed to the curved portion of the partition wall 57 at a slight spacing in the front and back directions. Each of the shutter guide parts 144 is formed in a curved shape with substantially the same curvature as that of the curved portion of the partition wall 57.

Also, an upper end surface of each of the shutter support parts 65 is arranged in a position slightly lower than the upper edge of each of the side plates 63. The upper end surface of each of the shutter support parts 65 forms an upper side fixed part 66.

Also, in the bottom plate 64, a lower side fixed part 67 slightly protruding to the front side is formed in the center of the width direction of the front edge.

Also, a shutter 68 for opening and closing the frame side passage ports 34 is disposed in the cartridge receiving part 33.

The shutter 68 is formed in substantially a rectangular shape extending in the width direction and is formed in a curved shape with substantially the same curvature as that of the curved portion of the partition wall 57. The shutter 68 is formed so as to extend between each of the shutter guide parts 144 in the width direction and extend slightly shorter than each of the shutter guide parts 144 in the upper and lower directions. Also, three shutter opening parts 69 capable of being opposed to the frame side passage ports 34 corresponding to each of the frame side passage ports 34 are formed in the shutter 68.

The shutter 68 is arranged as opposed to the curved portion of the partition wall 57, and both ends of a width direction of the shutter 68 are slidably pinched between the partition wall 57 and each of the shutter guide parts 144.

Consequently, the shutter 68 is supported slidably along the each of the shutter guide parts 144 in the upper and lower directions between an opened position (see FIG. 3) in which the frame side passage ports 34 are opened and a closed position (see FIGS. 2 and 7) in which the frame side passage ports 34 are closed. When the shutter 68 is in the opened position, each of the frame side passage ports 34 is opposed to the corresponding shutter opening parts 69 and is opened to the outside (front side). When the shutter 68 is in the closed position, each of the frame side passage ports 34 is closed from the front side by the portions of the lower sides than the shutter opening parts 69 in the shutter 68.

Also, a swing arm 70 as one example of an operation member is disposed in the cartridge receiving part 33. The swing arm 70 is formed in substantially a U shape in the case of being viewed from the plane. The swing arm 70 integrally includes a grasp bar 71 extending in the width direction, and arm side plates 72 backward extending from both ends of the width direction of a grasp bar 71.

A boss 73 outward protruding in the width direction is disposed in the back end of each of the arm side plates 72. Each of the bosses 73 is rotatably supported in a circular hole 74 formed in each of the side plates 63.

Also, a receiving recessed part 75 notched so as to be recessed to the lower side is formed in the upper side edge of the back end of each of the arm side plates 72.

Also, in an inside surface of the width direction of each of the arm side plates 72, a press recessed part 142 notched so as to be recessed from the upper side edge of each of the arm side plates 72 to the lower side is formed in a position of the front side from the receiving recessed part 75.

A grasp part 76 recessed to the upper side is formed in the center of the width direction of the grasp bar 71. Also, press protrusion parts 77 are disposed in both ends of the width direction of the grasp bar 71.

Using the boss 73 of each of the arm side plates 72 as a fulcrum, the swing arm 70 swings between a pressing release position (see FIGS. 2, 4, 7 and 8) in which the lower edge of each of the arm side plates 72 makes contact with the front edge of the bottom plate 64 and a pressing position (see FIGS. 3, 5 and 6) in which the developer cartridge 31 is pressed from the front side when the developer cartridge 31 is received in the cartridge receiving part 33.

(2) Developer Cartridge

The developer cartridge 31 includes an inside cabinet 81 as one example of a shutter with substantially a cylindrical shape for accommodating the developer, an outside cabinet 82 with substantially a cylindrical shape for receiving the inside cabinet 81, and a cover unit 100 arranged outside the outside cabinet 82 as shown in FIGS. 9 to 12. The inside cabinet 81 and the outside cabinet 82 function as one example of a cartridge cabinet.

(2-1) Inside Cabinet

The inside cabinet 81 integrally includes a cylindrical inside peripheral wall 83 extending in the width direction, and circular plate-shaped inside side walls 84 for closing both ends of the width direction of the inside peripheral wall 83 as shown in FIG. 9.

A boss part 85 with a circular thick plate shape outward bulging in the width direction is disposed in the center of each of the inside side walls 84. A through hole 120 is formed in a circular center position of the left boss part 85.

Also, a slide protrusion 86 is disposed in the radial outside from the boss part 85 and an upper side portion of each of the inside side walls 84. The slide protrusion 86 is formed in a circular arc shape (circular arc shape with a center angle of about 60°) in the case of being viewed from the side along an outer peripheral surface of the inside side wall 84, and is disposed so as to protrude from the inside side wall 84 to the outside of the width direction.

Also, a cartridge protrusion 121 is disposed in the side (specifically, the lower side of the boss part 85) opposite to the slide protrusion 86 with respect to the boss part 85 in each of the inside side walls 84. The cartridge protrusion 121 is formed in a rectangular shape in the case of being viewed from the side and is disposed so as to protrude from the inside sidewall 84 to the outside of the width direction.

Also, a pair of pinch protrusions 87 radially protruding from a peripheral end surface are disposed in a back side portion of each of the inside side walls 84. The pair of pinch protrusions 87 are arranged at a spacing (spacing corresponding to a circumferential length of the shutter 68) in a circumferential direction mutually in the peripheral end surface of each of the inside side walls 84.

In the inside peripheral wall 83, inside passage ports 89 as one example of inside openings for forming the cartridge side passage ports 47 are formed in a surrounded portion 88 surrounded by the pair of pinch protrusions 87 (four pinch protrusions 87) arranged in both sides of the width direction.

The inside passage ports 89 are formed in the upper side portion of the surrounded portion 88. Concretely, three inside passage ports 89 are formed at a spacing in the width direction. Each of the inside passage ports 89 is formed in substantially a rectangular shape elongated in the width direction. The inside passage port 89 formed in the center of the width direction among the inside passage ports 89 is used as an inside supply port 90 and the inside passage ports 89 of both sides of the width direction of an inside supply port 90 are used as inside return ports 91.

As shown in FIGS. 2 and 3, the agitator 93 described above is disposed inside the inside cabinet 81. The agitator 93 includes an agitator shaft 94 extending in the width direction, and an agitating blade 95 extending from the agitator shaft 94 to the radial outside. The agitator shaft 94 is rotatably supported in both the inside side walls 84. Specifically, a passive gear 122 shown in FIG. 9 is mounted in the left end of the agitator shaft 94. The passive gear 122 is formed in a columnar shape and is exposed from the through hole 120 of the boss part 85 described above to the outside. Also, a recessed part (called an engaging recessed part 123) recessed to the right side and having substantially an 8 shape in the case of being viewed from the left side is formed in a left side surface of the passive gear 122. At the time of forming an image, the passive gear 122 is joined to a driving gear (not shown) of a motor (not shown) of the body casing 2 in the engaging recessed part 123. As a result of that, driving force from the motor (not shown) is transmitted to the agitator shaft 94 and the agitator 93 (concretely, the agitating blade 95) rotates around the agitator shaft 94. Consequently, the developer accommodated inside of the developer cartridge 31 is agitated.

(2-2) Outside Cabinet

The outside cabinet 82 is formed slightly larger than the inside cabinet 81 in the width and radial directions in order to rotatably receive the inside cabinet 81. The outside cabinet 82 integrally includes an outside peripheral wall 101 with substantially a cylindrical shape extending in the width direction, and substantially semicircular plate-shaped outside side walls 102 for closing substantially upper half portions in both ends of the width direction of the outside peripheral wall 101 as shown in FIG. 10.

A circular boss hole 103 for receiving the boss part 85 is formed in a circular center position of each of the outside side walls 102. Also, a slide hole 104 into which the slide protrusion 86 is inserted is formed in an upper side portion of each of the outside side walls 102. The slide hole 104 is arranged as opposed to the slide protrusion 86 in the width direction. The slide hole 104 is formed in a circular arc shape with a circumferential length longer than that of the slide protrusion 86 in the case of being viewed from the side.

Also, a back side portion of each of the outside side walls 102 is formed so as to be further recessed to the inside of the width direction along the peripheral edge of the outside side wall 102. In addition, the recessed portion is called a recessed part 124. In each of the outside side walls 102, a backward protruding upper side part 105 to be fixed is formed in the upper end of the recessed part 124. A positioning boss 106 outward protruding in the width direction is disposed in the back end of the upper side part 105 to be fixed.

Also, in the recessed part 124 of each of the outside side walls 102, a guide rail 125 as one example of a guide groove is formed under the upper side part 105 to be fixed. The guide rail 125 is formed so as to notch the outside peripheral edge in the recessed part 124 of each of the outside side walls 102. Also, a depth (notch depth) of the guide rail 125 is formed so as to become deep as the guide rail 125 is located from the lower side toward the upper side (the side of the upper side part 105 to be fixed).

Also, forward bulging pressed parts 107 are disposed on the front sides (both ends of the width direction of the front side of the outside peripheral wall 101) of peripheral end surfaces of each of the outside side walls 102 as shown in FIG. 7. The pressed part 107 is formed in substantially a rectangular shape in the case of being viewed from the front and substantially a circular arc shape extending from the front side of each of the outside side walls 102 to the lower side in the case of being viewed from the side.

Four elongated holes 108 into which the pair of pinch protrusions 87 (four pinch protrusions 87) are respectively inserted are formed in both ends of the width direction in the outside peripheral wall 101 as shown in FIG. 10. Each of the elongated holes 108 is arranged as opposed to each of the pinch protrusions 87 in a radial direction. Each of the elongated holes 108 is formed in substantially a rectangular shape extending in the upper and lower directions in the case of being viewed from the rear and is formed in a length corresponding to a swing range between the opened position and the closed position of the shutter 68 described above. Here, the guide rail 125 is positioned between the elongated holes 108 arranged in a circumferential direction.

Also, in the outside peripheral wall 101, outside passage ports 109 as one example of openings for forming the cartridge side passage ports 47 are formed between the four elongated holes 108 (between the two elongated holes 108 of the upper side and the two elongated holes 108 of the lower side).

The three outside passage ports 109 are formed at a spacing in the width direction. Each of the outside passage ports 109 is formed in substantially a rectangular shape elongated in the width direction. The outside passage port 109 formed in the center of the width direction among the outside passage ports 109 is used as an outside supply port 110 and the outside passage ports 109 of both sides of the width direction of the outside supply port 110 are used as outside return ports 111.

Here, the guide rails 125 are respectively formed in both ends of the width direction of the outside passage ports 109 in the outside cabinet 82, that is, in the left side of the left outside return port 111 and the right side of the right outside return port 111.

The outside supply port 110 is opposed to the frame side supply port 60 and the two outside return ports 111 are opposed to the two frame side return ports 61 in a state of attaching the developer cartridge 31 to the process frame 22 (see FIGS. 8 and 10).

Also, in the front side of the outside peripheral wall 101, a grip part 113 is disposed in the center of the width direction as shown in FIG. 7.

The grip part 113 includes an upper grasp plate 114 with substantially a rectangular shape forward protruding from the outside peripheral wall 101, and a locking arm 115 with substantially a J shape in the case of being viewed from the side downward extending from the upper grasp plate 114. The upper end of the locking arm 115 is swingably supported in a support shaft 116 disposed in the upper grasp plate 114. A locking claw 117 for locking in the lower side fixed part 67 is disposed in the lower end of the locking arm 115. A lower grasp plate 118 with substantially a rectangular shape forward protruding is disposed in the vicinity of the upper end of the locking arm 115. The lower grasp plate 118 is arranged so as to extend in spaced parallel with the upper grasp plate 114.

A compression spring (not shown) for urging the grasp plates in a direction of separation is interposed between the upper grasp plate 114 and the lower grasp plate 118.

(2-3) Cover Unit

The cover unit 100 includes a cover 126 and a support lever 127 as shown in FIG. 12. In addition, in description of the cover unit 100, an attitude of the cover unit 100 in FIG. 12 is used as the reference.

The cover 126 is formed in substantially a rectangular plate shape extending in the width direction and is formed in a circular arc shape with substantially the same curvature as that of the outside peripheral wall 101. Both ends of the width direction of the upper edge of the cover 126, specifically, the portions matching with the elongated holes 108 in the width direction are notched downward in a rectangular shape (this portion is called a notched portion 132).

In the cover 126, a cover seal 131 as one example of a seal member is disposed on a surface of the center side (front side) of the circular arc. The cover seal 131 has a shape similar to that of the cover 126 and is formed by a sheet such as a sponge. The surface of the circular arc center side of the cover 126 is coated with the cover seal 131. In addition, the cover seal 131 is hereinafter regarded as a part of the cover 126.

Also, in both ends of the width direction of the cover 126, an engaging part 128 is integrally disposed in the upper end and a cover protrusion 129 is integrally disposed in substantially the center of the upper and lower directions and a joint part 130 is integrally disposed in the lower end.

Each of the engaging parts 128 is protruded from both ends of the width direction of the cover 126 toward the circular arc center side (front side) of the cover 126. Also, each of the engaging parts 128 is formed so as to bulge in a circular arc shape in the protrusion direction in the case of being viewed from the side.

Each of the cover protrusions 129 is formed in a rectangular shape in the case of being viewed from the side and is protruded from both ends of the width direction of the cover 126 toward the outside of the width direction.

Each of the joint parts 130 is protruded from both ends of the width direction of the cover 126 toward a direction (back side) separated from the circular arc center of the cover 126. Also, each of the joint parts 130 is formed so as to bulge in a circular arc shape in the protrusion direction in the case of being viewed from the side, and a joint hole (not shown) recessed to the inside of the width direction is disposed in an outside surface of the width direction.

The support levers 127 are respectively disposed in both end sides of the width direction of the cover 126. Each of the support levers 127 is formed in substantially an inverted L shape in the case of being viewed from the left side, and integrally includes substantially bar-shaped first arm part 133 and second arm part 134.

In the first arm part 133, one end (upper end) is formed in a ring shape with a diameter larger than that of the boss part 85 and a lever first protrusion 135 is disposed between one end and the other end (lower end). The lever protrusion 135 is formed in a rectangular shape in the case of being viewed from the side and is disposed so as to protrude from the first arm part 133 to the outside of the width direction.

In the second arm part 134, a pressed protrusion 136 as one example of a protrusion part is disposed in one end (front end) and a joint protrusion (not shown) is disposed in the other end (back end) and a lever second protrusion 137 is disposed between one end and the other end (specifically, a position deviating to the side of the other end). The pressed protrusion 136 is formed in a columnar shape protruding from the second arm part 134 to the outside of the width direction. The joint protrusion (not shown) is formed in a columnar shape protruding from the second arm part 134 to the inside of the width direction. The lever second protrusion 137 is downward protruded from the second arm part 134 to the inside of the width direction.

The other end of the first arm part 133 is connected between one end and the other end (specifically, a position deviating to the side of one end) of the second arm part 134.

The cover 126 is supported in each of the support levers 127 in both ends of the width direction of the cover 126.

Concretely, by inserting the joint protrusion (not shown) of each of the support levers 127 into the corresponding joint hole (not shown) in the cover 126, the cover 126 is joined to each of the support levers 127 in each of the joint parts 130 and is swingably supported. Here, a coil spring 138 as one example of a second urging member having two arm parts is wound on the joint protrusion (not shown) of each of the support levers 127. In the coil spring 138, one arm part is locked in the corresponding cover protrusion 129 and the other arm part is locked in the lever second protrusion 137 of each of the corresponding support levers 127. Consequently, the cover 126 is always urged to the circular arc center side.

(2-4) Relative Arrangement of Inside Cabinet and Outside Cabinet

The inside cabinet 81 is rotatably received inside the outside cabinet 82.

Concretely, an outer peripheral surface of the inside peripheral wall 83 is inward fitted slidably in a circumferential direction with respect to an inner peripheral surface of the outside peripheral wall 101 (see FIGS. 2 and 3). The boss part 85 is rotatably supported in the boss hole 103. The slide protrusion 86 is inserted into the slide hole 104. Each of the pinch protrusions 87 is inserted into each of the elongated holes 108, and each of the pinch protrusions 87 is protruded from each of the elongated holes 108 to the outside of a radial direction (see FIG. 11).

The inside cabinet 81 permits relative rotates using the boss part 85 as a fulcrum between a closed position (see FIGS. 2 and 11) in which the inside passage ports 89 are not opposed to the outside passage ports 109 and an opened position (see FIGS. 3 and 10) in which the inside passage ports 89 are opposed to the outside passage ports 109 with respect to the outside cabinet 82.

When the inside cabinet 81 is arranged in the closed position, as shown in FIG. 11, each of the slide protrusions 86 is arranged in the front end of each of the slide holes 104, and each of the pinch protrusions 87 is arranged in the upper end of each of the elongated holes 108, and the inside passage ports 89 are arranged in the side upper than the outside passage ports 109 (see FIG. 2), and the outside passage ports 109 are closed by the lower side portion of the surrounded portion 88. Then, the inside cabinet 81 is relatively rotated in a direction (lower side) in which the inside passage ports 89 move toward the outside passage ports 109 with respect to the outside cabinet 82 using the boss part 85 as a fulcrum (see FIG. 3). Then, each of the slide protrusions 86 slides each of the slide holes 104 from the front end toward the back end, and each of the pinch protrusions 87 slides each of the elongated holes 108 from the upper end toward the lower end.

Thereafter, when each of the slide protrusions 86 abuts on the back edge of each of the slide holes 104 and each of the pinch protrusions 87 abuts on the lower edge of each of the elongated holes 108, the inside cabinet 81 is arranged in the opened position as shown in FIG. 10.

When the inside cabinet 81 is arranged in the opened position, each of the slide protrusions 86 is arranged in the back end of each of the slide holes 104, and each of the pinch protrusions 87 is arranged in the lower end of each of the elongated holes 108, and the inside passage ports 89 are opposed to the outside passage ports 109 and these passage ports are communicated and opened.

In addition, when the inside cabinet 81 is relatively rotated in a direction in which the inside passage ports 89 rise from the outside passage ports 109 with respect to the outside cabinet 82 using the boss part 85 as the fulcrum, each of the slide protrusions 86 abuts on the front edge of each of the slide holes 104 and each of the pinch protrusions 87 abuts on the upper edge of each of the elongated holes 108 and the inside cabinet 81 is arranged in the closed position as shown in FIG. 11.

In this manner, the inside cabinet 81 opens and closes the outside passage ports 109.

In addition, each of the cartridge protrusion 121 disposed in the inside cabinet 81 always protrudes to the outside of the width direction in the lower side of the corresponding outside side wall 102.

(2-5) Relative Arrangement of Cover Unit with Respect to Inside Cabinet and Outside Cabinet The cover unit 100 is rotatably mounted with respect to the inside cabinet 81 and the outside cabinet 82.

Specifically, one end of the ring shape in the first arm part 133 of each of the support levers 127 is loosely fitted in the boss part 85 in the inside of the width direction of the outside side walls 102, and the cover unit 100 is supported in the inside cabinet 81 in each of the boss parts 85. In this state, the cover unit 100 is rotatable with respect to the inside cabinet 81 and the outside cabinet 82.

In addition, the lever first protrusion 135 of each of the first arm parts 133 always protrudes to the outside of the width direction in the lower side of the corresponding outside side wall 102.

The cover 126 is also rotatable with respect to the inside cabinet 81 and the outside cabinet 82 with the cover unit 100. The cover 126 is rotatably supported in the inside cabinet 81 around each of the boss parts 85 (specifically, around a line through the rotation shaft of the inside cabinet 81) between the closed position (see FIG. 12) and the opened position (see FIGS. 10 and 11).

Concretely, when the cover 126 is in the closed position, as shown in FIG. 12, the outside passage ports 109 are closed from the outside and the lower pinch protrusion 87 of the pair of pinch protrusions 87 is covered from the outside. In contrast, when the cover 126 is in the opened position, as shown in FIG. 11, the cover 126 is located in the side lower than the closed position and the outside passage ports 109 are opened to the outside and in each of the notched portions 132, the lower pinch protrusion 87 of the pair of pinch protrusions 87 is exposed to the radial outside.

Also, the end (called a far end 140, which is an example of a first end and is the front end in FIG. 10 and is the lower end in FIGS. 11 and 12) farthest from the outside passage ports 109 in the cover 126 located in the opened position is always in intimate contact with the outside peripheral wall 101 of the outside cabinet 82 over the width direction. Here, the cover seal 131 described above is disposed between the cover 126 and the outside peripheral wall 101, so that the far end 140 is in intimate contact with the outside peripheral wall 101 without a gap. In contrast, the end (called a near end 141, which is an example of a second end and is the back end in FIG. 10 and is the upper end in FIGS. 11 and 12) nearest to the outside passage ports 109 in the cover 126 located in the opened position is always separated from the outside peripheral wall 101 to the radial outside over the width direction when the cover 126 is in positions other than the closed position (including the time when the cover 126 is moving).

Here, when the cover 126 moves from the opened position (see FIG. 11) to the closed position side (see FIG. 12) and each of the engaging parts 128 of the cover 126 reaches the lower end of the corresponding guide rail 125, each of the engaging parts 128 engages with the guide rail 125. Then, in a state in which each of the engaging parts 128 engages with the guide rail 125, the cover 126 is guided to the guide rail 125 and subsequently moves to the closed position side. At this time, each of the engaging parts 128 is fitted into the guide rail 125 which becomes deep as the guide rail 125 is located from the lower side (opened position side) toward the upper side (closed position side) as described above and accordingly, the near end 141 approaches the outside peripheral wall 101. Then, as shown in FIG. 12, when the cover 126 moves to the closed position, each of the engaging parts 128 reaches the deepest part of the guide rail 125 and accordingly, the near end 141 of the cover 126 makes intimate contact with the outside peripheral wall 101. Here, the cover seal 131 described above is disposed between the cover 126 and the outside peripheral wall 101, so that the near end 141 is in intimate contact with the outside peripheral wall 101 without a gap. Also, as described above, the far end 140 is always in intimate contact with the outside peripheral wall 101, and the cover 126 located in the closed position closes the outside passage ports 109 from the outside.

In contrast, when the cover 126 moves from the closed position to the opened position side, the near end 141 is separated from the outside peripheral wall 101 along the guide rail 125 which becomes shallow as the guide rail 125 is located from the closed position toward the opened position.

Also, a coil spring 139 as one example of a first urging member having two arm parts is wound on each of the boss parts 85. In the coil spring 139, one arm part is locked in the cartridge protrusion 121 and the other arm part is locked in the lever first protrusion 135 of each of the corresponding support levers 127. Consequently, the cover unit 100 (specifically, the cover 126) is always urged toward the upper side (closed position). Also, the coil spring 138 described above always urges the cover 126 toward the circular arc center side, that is, the outside peripheral wall 101.

(3) Attachment and Detachment of Developer Cartridge to and from Process Frame (3-1) Attachment of Developer Cartridge to Process Frame When the developer cartridge 31 is attached to the process frame 22, the upper grasp plate 114 and the lower grasp plate 118 of the grip part 113 are first pinched in a direction in which their grasp plates move near as shown in FIG. 7. Then, the developer cartridge 31 (the inside cabinet 81 is arranged in a closed position and the cover 126 is in the closed position) is attached to the cartridge receiving part 33 (the shutter 68 is arranged in the closed position and the swing arm 70 is arranged in a pressing release position).

Concretely, each of the pressed protrusions 136 of the cover unit 100 first engages with the corresponding press recessed part 142 in the swing arm 70. When the developer cartridge 31 is subsequently moved to the side of the cartridge receiving part 33 in this state, press force of a direction opposite to a movement direction (attachment direction) of the developer cartridge 31 is exerted on the pressed protrusion 136 from the swing arm 70 standing still in the pressing release position in the press recessed part 142. Consequently, the cover 126 moves (falls) to the opened position side in a state in which the far end 140 is in intimate contact with the outside peripheral wall 101 against urging force of the coil spring 139 (see FIG. 4). The near end 141 is separated from the outside peripheral wall 101 according to this movement.

Then, when each of the positioning bosses 106 is placed on each of the upper side fixed parts 66 and a pair of the pinch protrusions 87 of both sides of the width direction respectively pinch the upper edge and the lower edge of both ends of the width direction of the shutter 68 and each of the slide protrusions 86 is fitted into each of the receiving recessed parts 75 (see FIG. 6), movement of the cover 126 to the opened position is completed (see FIGS. 4 and 11). At this time, the far end 140 is in intimate contact with the outside peripheral wall 101 while the near end 141 is separated from the outside peripheral wall 101, so that the cover 126 and the outside peripheral wall 101 are formed in substantially a 9 shape in the case of being viewed from the left side, and a recessed part 148 narrowing from the side of the near end 141 toward the far end 140 is formed between the cover 126 and the outside peripheral wall 101 (see FIG. 4).

Thereafter, when the pinch of the grip part 113 is released, the locking claw 117 is locked in the lower side fixed part 67 and the developer cartridge 31 is received in the cartridge receiving part 33 as shown in FIG. 4.

The outside cabinet 82 is fixed to the cartridge receiving part 33 since the positioning bosses 106 are placed to the upper side fixed parts 66 and the locking claw 117 is locked to the lower side fixed part 67. Consequently, attachment of the developer cartridge 31 to the process frame 22 is completed.

Then, the swing arm 70 is swung from the pressing release position to a pressing position. Then, each of the press protrusion parts 77 presses each of the pressed part 107 toward the back side as shown in FIG. 5. Consequently, the developer cartridge 31 is pressed toward the developing part 32. Also, when the swing arm 70 is swung from the pressing release position to the pressing position, press force is exerted on the pressed protrusion 136 engaging with the press recessed part 142 from the swing arm 70 swung, and the cover 126 located in the opened position further moves in a position (called a retracted position) distant from the outside passage ports 109 (see FIG. 3). In addition, the retracted position shall be included in the opened position.

Also, when the swing arm 70 is swung from the pressing release position to the pressing position, with swing of each of the arm side plates 72, each of the slide protrusions 86 fitted into each of the receiving recessed parts 75 slides each of the slide holes 104 to the back side and is arranged in the back end of each of the slide holes 104. Further, with the shutter 68 pinched, a pair of the pinch protrusions 87 of both sides of the width direction slide each of the elongated holes 108 to the lower side and are arranged in the lower end of each of the elongated holes 108.

Consequently, as shown in FIG. 3, the inside cabinet 81 is arranged in the opened position and the inside passage ports 89 are opposed to the outside passage ports 109 and these passage ports are communicated. The shutter 68 is arranged in the opened position and the frame side passage ports 34 are opposed to the cartridge side passage ports 47 (the inside passage ports 89 and the outside passage ports 109) and these passage ports are communicated.

Then, when forming an image, by agitating the agitator 93, the developer accommodated inside of the inside cabinet 81 is supplied from the inside supply port 90 and the outside supply port 110 (see FIG. 10) to the side of the developing part 32 and is received inside the developing part 32 in the frame side supply port 60 (see FIG. 8).

In contrast, according to the auger 35, the developer supplied from the frame side supply port 60 to the inside of the developing part 32 is transported from the center of the width direction to both sides of the width direction and is supplied to the supply roller 36 on the way. The developer supplied to the supply roller 36 is supplied to the developing roller 37 as described above. The developer which has not been supplied to the supply roller 36 is transported to the frame side return ports 61 (see FIG. 8) and passes through the outside return ports 111 and the inside return ports 91 (see FIG. 10) and is returned from the developing part 32 to the inside of the inside cabinet 81. Consequently, the developer is circulated between the developing part 32 and the inside cabinet 81.

(3-2) Detachment of Developer Cartridge from Process Frame

When the developer cartridge 31 is detached from the process frame 22, the swing arm 70 is first swung from the pressing position to the pressing release position. Then, each of the press protrusion parts 77 is separated from each of the pressed part 107 and a press of the developer cartridge 31 on the developing part 32 is released as shown in FIG. 4. Also, with this, the cover 126 located in the retracted position moves to the opened position with rotation of the inside cabinet 81.

Also, when the swing arm 70 is swung from the pressing position to the pressing release position, with swing of each of the arm side plates 72, each of the slide protrusions 86 fitted into each of the receiving recessed parts 75 slides each of the slide holes 104 to the front side and is arranged in the front end of each of the slide holes 104. Further, with the shutter 68 pinched, a pair of the pinch protrusions 87 of both sides of the width direction slide each of the elongated holes 108 to the upper side and are arranged in the upper end of each of the elongated holes 108.

Consequently, as shown in FIG. 2, the inside cabinet 81 is arranged in the closed position, and the upper side portion (see FIG. 11) of the surrounded portion 88 is opposed to the outside passage ports 109, and the outside passage ports 109 are closed. Also, the shutter 68 is arranged in the closed position, and the frame side passage ports 34 are opposed to the shutter 68 and are closed.

Then, when the upper grasp plate 114 and the lower grasp plate 118 of the grip part 113 are pinched in a direction in which their grasp plates move near, locking of the locking claw 117 to the lower side fixed part 67 is released, so that when the developer cartridge 31 is pulled from the cartridge receiving part 33 to the front side as it is, the developer cartridge 31 is detached from the process frame 22. When the developer cartridge 31 is detached from the process frame 22, engagement between the pressed protrusion 136 and the press recessed part 142 is released as shown in FIGS. 4 and 7, so that the cover 126 located in the opened position moves (rises) to the closed position by urging force of the coil spring 139. In this movement, the near end 141 approaches the outside peripheral wall 101 and finally makes intimate contact with the outside peripheral wall 101. Also, the far end 140 is always in intimate contact with the outside peripheral wall 101. As a result of that, when the cover 126 moves to the closed position, the recessed part 148 between the cover 126 and the outside peripheral wall 101 described above gradually disappears (decreases) while an opening of the recessed part 148 moves upward.

In the developer cartridge 31, as shown in FIG. 2, during movement of the cover 126 from the opened position to the closed position, the far end 140 of the cover 126 rises while being in intimate contact with the outside cabinet 82 and also, the near end 141 of the cover 126 rises in a state of being separated from the outside cabinet 82.

As a result, even when the developer received inside of the outside cabinet 82 runs from the outside passage ports 109 to a surface of the outside of the outside cabinet 82 (specifically, the outside peripheral wall 101) and spills to the lower side, the developer enters between the cover 126 (specifically, the cover seal 131) and the outside cabinet 82 (specifically, the recessed part 148 described above) from the near end 141 and is accumulated in the far end 140. Then, when the cover 126 rises to the closed position, the far end 140 rises while being in intimate contact with the outside cabinet 82 and finally, the outside passage ports 109 are covered with the cover 126 from the outside, so that while the developer spilling from the outside passage ports 109 is scooped up during closure of the outside passage ports 109 by the inside cabinet 81, the developer is accumulated in the far end 140 and also the developer adhering to the vicinity of the outside passage ports 109 is covered from the outside and leakage of more developer can be prevented surely.

Further, as shown in FIGS. 2 and 3, the developer cartridge 31 can be formed in a double structure including the outside cabinet 82 and the inside cabinet 81. Also, by opposing the outside passage ports 109 of the outside cabinet 82 to the inside passage ports 89 of the inside cabinet 81, the developer can be moved to the inside and the outside of the outside cabinet 82 through the outside passage ports 109 and the inside passage ports 89 (see FIG. 3).

Further, the inside cabinet 81 is a shutter which is rotatable with respect to the outside cabinet 82 and opens and closes the outside passage ports 109 according to the rotation of the inside cabinet 81.

As a result, by rotating the inside cabinet 81 and opening the outside passage ports 109 and opposing the outside passage ports 109 to the inside passage ports 89, the developer can be moved to the inside and the outside of the outside cabinet 82 through the outside passage ports 109 and the inside passage ports 89. In contrast, movement of the developer to the inside and the outside of the outside cabinet 82 can be regulated by rotating the inside cabinet 81 and closing the outside passage ports 109 (see FIG. 2).

Then, by disposing the cover 126 as described above, while the developer spilling from the outside passage ports 109 is scooped up during closure of the outside passage ports 109 by the inside cabinet 81, the developer is accumulated in the far end 140 and also the developer adhering to the vicinity of the outside passage ports 109 is covered from the outside and thereby, leakage of more developer can be prevented surely.

Further, the near end 141 makes intimate contact with the outside cabinet 82 when the cover 126 moves in a closed position.

As a result, both of the near end 141 and the far end 140 of the cover 126 make intimate contact with the outside cabinet 82 when the cover 126 moves in the closed position, so that the outside passage ports 109 are sealed with the cover 126.

As a result, leakage of the developer can be prevented more surely.

As shown in FIG. 11, the guide rail 125 for engaging with the cover 126 and guiding movement of the cover 126 is formed in the outside cabinet 82, so that the cover 126 can be moved smoothly and surely between the closed position and the opened position by guiding the cover 126 to the guide rail 125.

Further, the guide rail 125 becomes deep as the cover 126 is located from the opened position toward the closed position. As a result, when the cover 126 is in the opened position, the near end 141 is surely separated from the outside cabinet 82 and approaches the outside cabinet 82 as the cover 126 is located from the opened position toward the closed position and when the cover 126 is in the closed position, the near end 141 can surely be brought into intimate contact with the outside cabinet 82 (see FIG. 12).

The cover seal 131 is disposed between the cover 126 and the outside cabinet 82 (specifically, the outside peripheral wall 101), so that the far end 140 is surely brought into intimate contact with the outside cabinet 82 and when the cover 126 is in the closed position, the near end 141 is surely brought into intimate contact with the outside cabinet 82 and the outside passage ports 109 can be sealed with the cover 126 (see FIG. 12).

As shown in FIG. 12, the developer cartridge 31 includes the coil spring 139 for urging the cover 126 toward the closed position, so that the outside passage ports 109 are closed by the cover 126 in a normal state.

The developer cartridge 31 includes the coil spring 138 for urging the cover 126 toward the outside cabinet 82. As a result, the near end 141 of the cover 126 can surely be brought into intimate contact with the outside cabinet 82 when the cover 126 is in the closed position.

As a result of that, leakage of the developer can be prevented surely.

As shown in FIG. 10, the outside passage ports 109 are formed in the outside peripheral wall 101 of the outside cabinet 82 and as shown in FIG. 12, the guide rails 125 are formed in both ends of the width direction of the outside passage ports 109 in the outside cabinet 82, and the cover 126 includes the engaging parts 128 for engaging with the guide rails 125 in both ends of the width direction.

Consequently, the portion of engagement between the cover 126 and the guide rails 125 is not arranged inside the outside passage ports 109, so that smooth movement of the cover 126 and smooth movement of the developer in the outside passage ports 109 can be ensured.

Also, as shown in FIGS. 10, 11 and 12, the cover 126 is rotatably supported in the inside cabinet 81 and the outside cabinet 82 around a line through the rotation shaft of the inside cabinet 81. Consequently, by matching the rotation center of the cover 126 with the rotation center of the inside cabinet 81, the developer cartridge 31 can be constructed simpler than the case of separately forming these centers.

Also, as shown in FIG. 2, the developer cartridge 31 is detachably attached to the process frame 22 of the developing device 17, so that the developing device 17 can be newly replenished with the developer by replacing the developer cartridge 31.

Then, as shown in FIG. 4, the developer cartridge 31 includes the pressed protrusion 136. The pressed protrusion 136 moves the cover 126 from the closed position to the opened position according to attachment of the developer cartridge 31 to the process frame 22. As a result, by only attaching the developer cartridge 31 to the process frame 22, the cover 126 can be moved to the opened position to open the outside passage ports 109, so that operability can be improved.

Also, the pressed protrusion 136 can surely move the cover 126 from the closed position to the opened position according to attachment of the developer cartridge 31 to the process frame 22 by simple construction of being pressed on the swing arm 70 disposed in the process frame 22.

MODIFIED EXAMPLES

In the above-described aspects, the developing device 17 integrally includes the photoconductive drum 25 and the developing roller 37, and the developing device 17 is detachably attached to the body casing 2. Additionally, while a developing cartridge without including the photoconductive drum 25 is used as the developing device 17, another unit (i.e., drum cartridge) including the photoconductive drum 25 may be disposed and the developing cartridge may be detachably attached to the drum cartridge.

Further, the photoconductive drum 25, the scorotron-type charger 26 and the transfer roller 28 can also be disposed in the body casing 2 to detachably attach the developing cartridge to the body casing 2.

Still further, the developer cartridge 31 may singly be detachably attached to the body casing 2. In that case, the developing device 17 (that is, the process frame 22) to which the developer cartridge 31 is not attached can be attached to and detached from the body casing 2, and the developer cartridge 31 is attached to and detached from the process frame 22 attached to the body casing 2.

Still further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

Still further, in the above-described aspects, the inside cabinet 81 is rotatable with respect to the outside cabinet 82. However, the outside cabinet 82 may be rotatable with respect to the inside cabinet 81, and the outside cabinet 82 may form a shutter. Additionally, by disposing the cover 126, while the developer spilling from the outside passage ports 109 is scooped up during a closure action of the outside cabinet 82, the developer is accumulated in the far end 140 and also the developer adhering to the vicinity of the outside passage ports 109 is covered from the outside and thereby, leakage of more developer can be prevented surely.

What is claimed is:

1. A developer cartridge comprising:

a cartridge cabinet that accommodates developer and includes an opening for enabling communication between an inside of the cartridge cabinet and an outside of the cartridge cabinet;

a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position.

2. The developer cartridge according to claim 1, wherein the cartridge cabinet comprises:

an outside cabinet including the opening; and an inside cabinet received in the outside cabinet, the inside cabinet in which an inside opening opposable to the opening is formed and the developer is accommodated, and wherein the inside cabinet is the shutter which is rotatable with respect to the outside cabinet and opens and closes the opening according to a rotation of the inside cabinet.

3. The developer cartridge according to claim 2, wherein the second end makes intimate contact with the cartridge cabinet when the cover moves to the closed position.

4. The developer cartridge according to claim 3, wherein the cartridge cabinet comprises a guide groove for engaging with the cover and guiding movement of the cover, a depth of the guide groove located in a position corresponding to the closed position is deeper than a depth of the guide groove located in a position corresponding to the opened position.

5. The developer cartridge according to claim 4, wherein a depth of the guide groove becomes gradually deeper as the groove approaches from the position corresponding to the opened position to the position corresponding to the closed position.

6. The developer cartridge according to claim 4, further comprising:

a seal member disposed between the cover and the cartridge cabinet.

7. The developer cartridge according to claim 4, further comprising:

a first urging member for urging the cover toward the closed position; and a second urging member for urging the cover toward the cartridge cabinet.

8. The developer cartridge according to claim 4, wherein the guide grooves are formed in both ends of the opening of the outside cabinet, and wherein the cover comprises an engaging part for engaging with the guide grooves.

9. The developer cartridge according to claim 2, wherein the cover is rotatably supported in the cartridge cabinet around a line through a rotating axis of the inside cabinet.

10. A developing device comprising:

a developer cartridge comprising:

a cartridge cabinet that accommodates developer and includes an opening for enabling communication between an inside of the cartridge cabinet and an outside of the cartridge cabinet;

a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position;

a developing cabinet, the developer cartridge being attachable to and detachable from the developing cabinet; and a developer carrier that is supported in the developing cabinet and carries the developer to a photosensitive member, wherein the developer cartridge further comprises a protrusion part for moving the cover from the closed position to the opened position according to attachment of the developer cartridge to the developing cabinet.

11. The developing device according to claim 10, wherein the developing cabinet comprises an operation member, and wherein the protrusion part moves the cover from the closed position to the opened position by being pressed on the operation member according to attachment of the developer cartridge to the developing cabinet.

12. An image forming apparatus comprising a developing device, the developing device comprising:

a developer cartridge comprising:

a cartridge cabinet that accommodates developer and includes an opening for enabling communication between an inside of the cartridge cabinet and an outside of the cartridge cabinet;

a shutter that opens and closes the opening; and a cover that is arranged outside the cartridge cabinet and is movable between a closed position for closing the opening and an opened position for opening the opening, the opened position being located lower than the closed position, wherein the cover is movable such that a first end of the cover is in intimate contact with the cartridge cabinet while a second end of the cover is separated from the cartridge cabinet, the first end being farthest from the opening in the cover located in the opened position, and the second end being nearest to the opening in the cover located in the opened position;

a developing cabinet, the developer cartridge being attachable to and detachable from the developing cabinet, the developing cabinet comprising an operation member, wherein the protrusion part moves the cover from the closed position to the opened position by being pressed on the operation member according to attachment of the developer cartridge to the developing cabinet; and a developer carrier that is supported in the developing cabinet and carries the developer to a photosensitive member, wherein the developer cartridge further comprises a protrusion part for moving the cover from the closed position to the opened position according to attachment of the developer cartridge to the developing cabinet.

* * * * *